US006508344B1

(12) United States Patent
Lu

(10) Patent No.: US 6,508,344 B1
(45) Date of Patent: Jan. 21, 2003

(54) HANDLE STRUCTURE FOR TURNING AND ADJUSTING DIRECTION

(75) Inventor: Lien Ching Lu, Miaoli Hsien (TW)

(73) Assignee: Ting Cheng Co., Ltd., Miaoli Hsien (TW)

( * ) Notice: Subject to any disclaimer, the term of this patent is extended or adjusted under 35 U.S.C. 154(b) by 0 days.

(21) Appl. No.: 10/028,679

(22) Filed: Dec. 28, 2001

(51) Int. Cl.[7] ..... A45C 13/00
(52) U.S. Cl. ..... 190/115; 16/900; 16/114.1
(58) Field of Search ..... 190/115, 117, 190/118, 18 R; 16/900, 429, 113.1, 114.1, 405; 286/655, 655.1, 47.371

(56) References Cited

U.S. PATENT DOCUMENTS 5,713,441 A * 2/1998 Chen ..... 190/115
5,884,362 A * 3/1999 Tsai ..... 16/113.1
6,009,598 A * 1/2000 Chang ..... 16/113.1
6,301,746 B1 * 10/2001 Myers et al. ..... 16/113.1
6,332,242 B1 * 12/2001 Chen ..... 16/113.1
6,409,207 B1 * 6/2002 Kuo ..... 280/655.1

OTHER PUBLICATIONS

Kuo, US 2001/0040080 A1, Nov. 15, 2001.*
Kou, US 2002/0014382 A1, Feb. 7, 2002.*

* cited by examiner

*Primary Examiner*—Lee Young
*Assistant Examiner*—Lien Ngo
(74) *Attorney, Agent, or Firm*—Rosenberg, Klein & Lee

(57) ABSTRACT

A handle structure for turning and adjusting the direction of a luggage handle includes a handle located on the top end of the luggage to fasten to extensible pulling bars of the luggage. The handle includes a handle section which has a bottom rim to fasten to a support section. The support section includes a control section which has a bottom end engaged with a turning section. The turning section has two sides coupled respectively with a left coupling elbow and a right coupling elbow of a coupling section.

6 Claims, 6 Drawing Sheets

HANDLE STRUCTURE FOR TURNING AND ADJUSTING DIRECTION

BACKGROUND OF THE INVENTION

1. Field of the Invention

The invention relates to a handle structure for turning and adjusting direction, and particularly a handle adapted for use on luggage that is capable of turning and adjusting direction.

2. Description of the Prior Art

The commonly used luggage or trunks generally have a handle which is fixedly mounted in one direction (mostly in parallel with the luggage). It is not flexible and cannot meet different requirements of consumers. The luggage thus made have functional deficiency and lack competitiveness on the market. There are still rooms for improvement.

SUMMARY OF THE INVENTION

In view of aforesaid disadvantages, it is a primary object of the invention to provide a handle that is turnable and adjustable to various directions.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
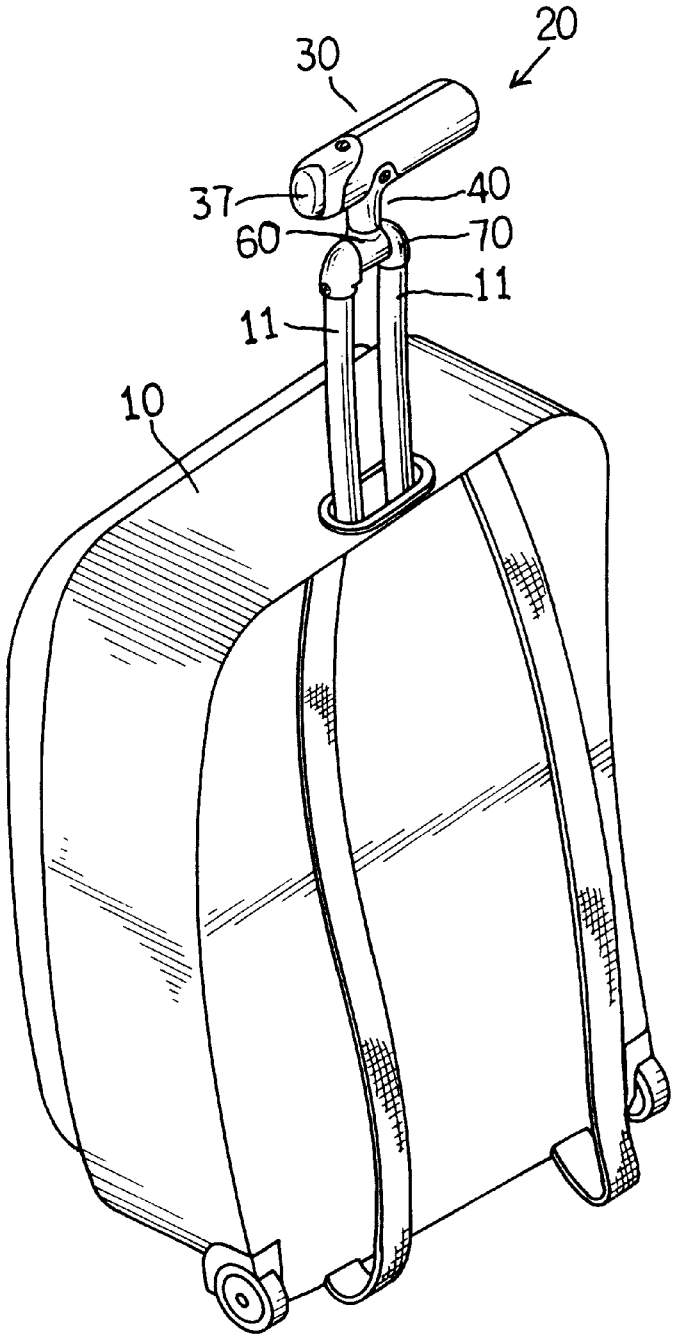
FIG.1 is a perspective view of the invention adapted to a luggage.
Figure 2:
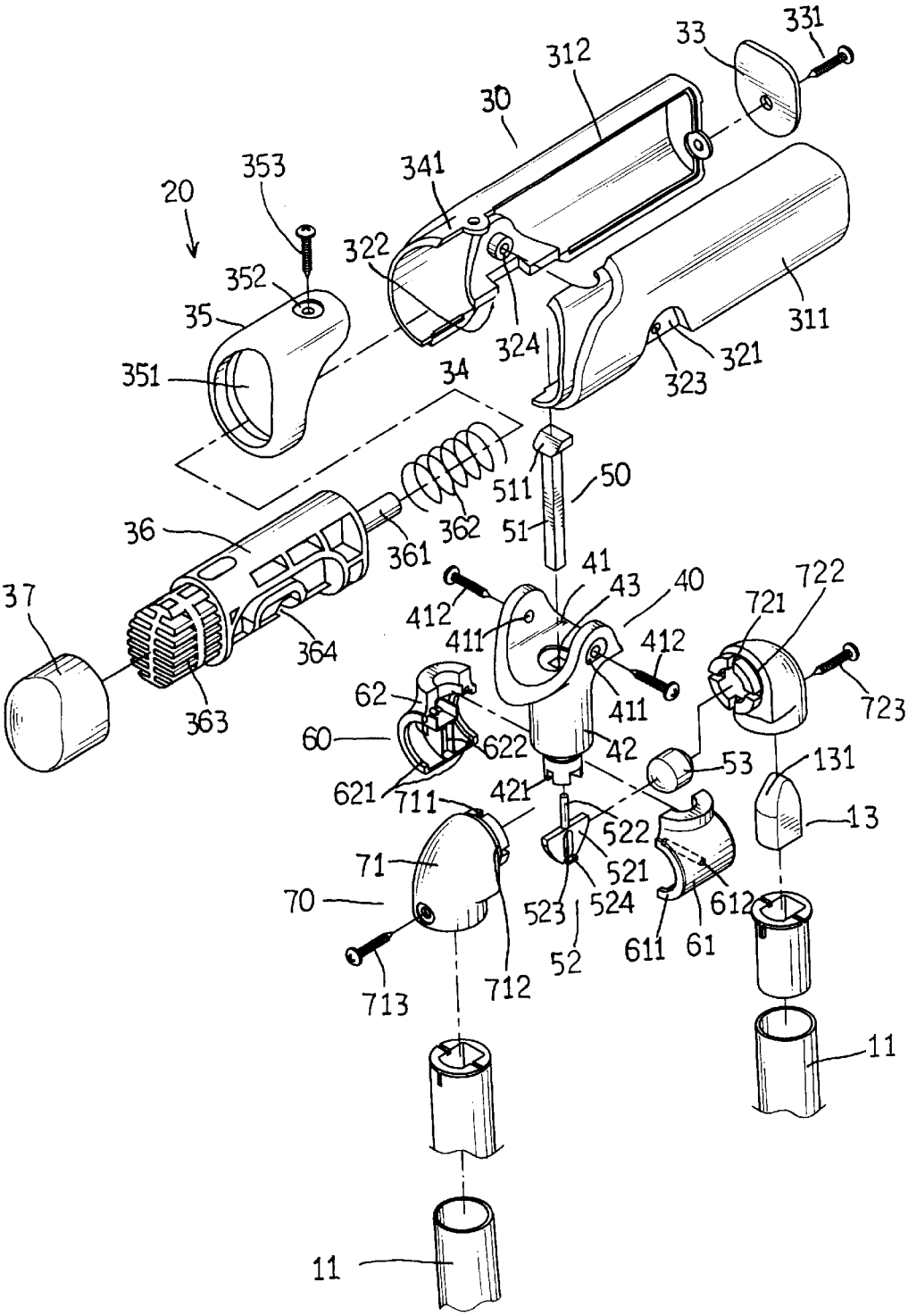
FIG.2 is an exploded view of the invention.
Figure 3:
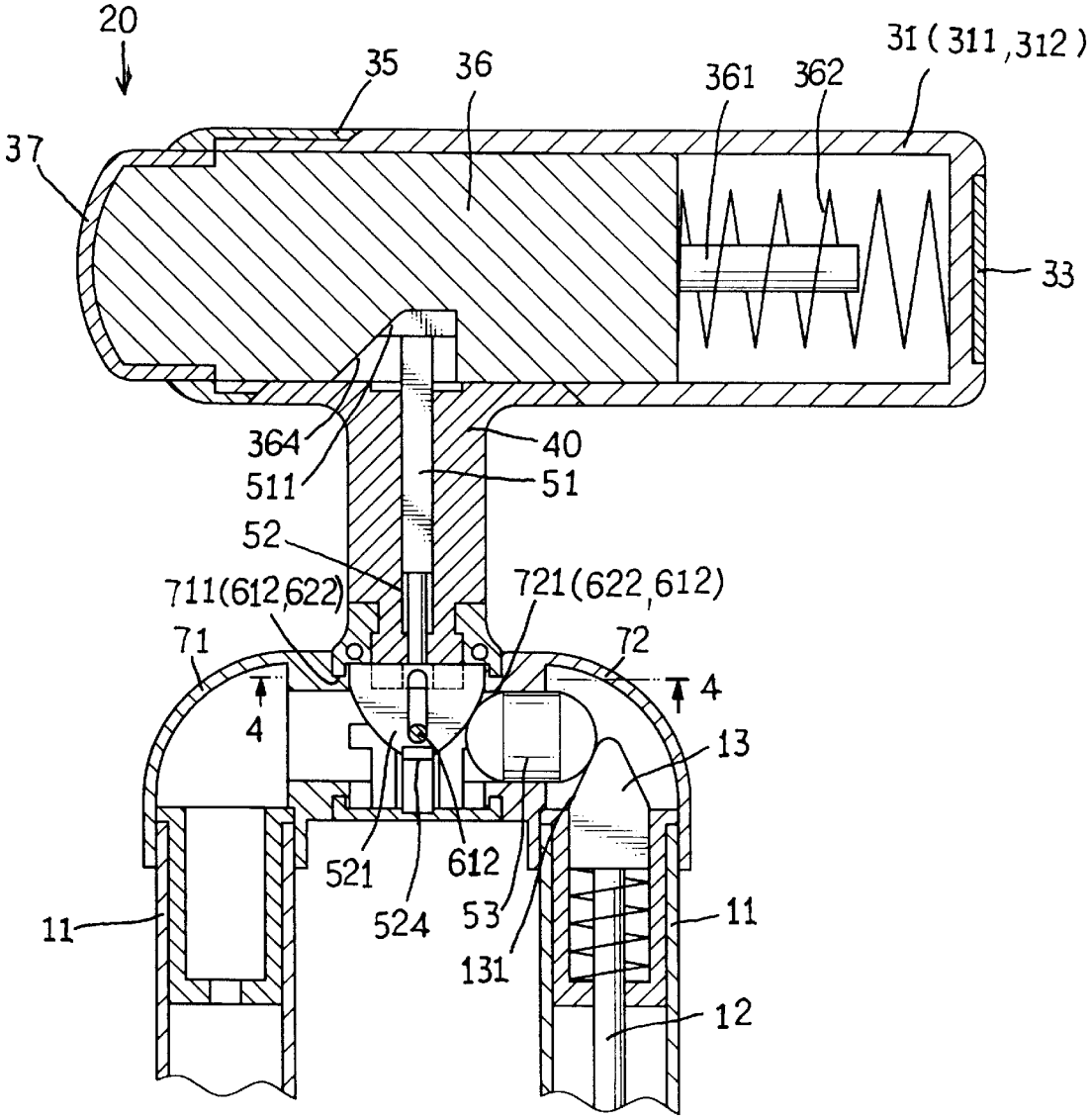
FIG.3 is a sectional view of the invention.
Figure 4:
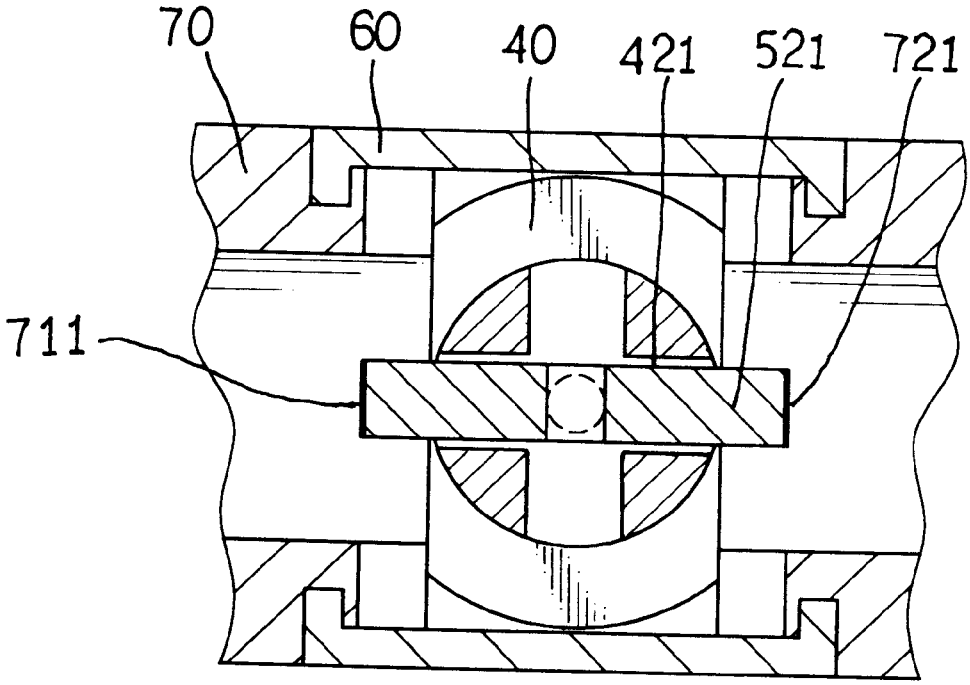
FIG.4 is a fragmentary cross section taken along line 4—4 in FIG. 3.

Referring to FIGS. 1 through 4, the invention mainly includes a handle 20 bridging the top ends of two pulling bars 11 of a luggage 10. The handle 20 can control control elements 12 of the pulling bars 11 for extension or retraction (such a technique is known in the art, and forms no part of the invention, thus will be omitted). The handle 20 includes a handle section 30, a support section 40, a control section 50, a turning section 60 and a coupling section 70.

The handle section 30 includes a casing 31 which is formed by coupling two arched shells 311, 312. The shells 311, 312 have respectively a side wall which has an indented recess 321, 322 to form a retain arch (not being marked in the drawings). The indented recesses 321, 322 have respectively a screw bore 323, 324. The casing 31 also has one end fastened to a fastening blade 33 through a screw 331, and another end formed an opening 34 and a coupling trough 341 for housing a coupling sleeve 35. The coupling sleeve 35 has an aperture 351 at one end and a screw bore 352 located on an upper side to engage with a screw,353 for fastening the coupling sleeve 35 to the casing 3l through the coupling trough 341. There is a push element 36 inserted in the aperture 351. The push element 36 has one end formed a jutting strut 361 to couple with a spring 362, and another end formed a jutting rim 363 to couple with a cap 37, and a bottom side which has a slant surface 364 formed thereon.

The support section 40 has a concave saddle seat 41 to couple with the retain arch of the handle section 30. The saddle seat 41 has two sides each has an aperture 411 to engage with a screw 412 for fastening the saddle seat 41 to the retain arch of the handle section 30 through the screw bores 323, 324. The saddle seat 41 further has a rod 42 located thereunder. The rod 42 has a bottom end forming a latch slot 421, and a through cavity 43 running through to house the control section 50.

The control section 50 includes a push rod 51 which has a bias edge 511 formed on the top end thereof to match the slant surface 364 of the push element 36. The push rod 51 has a bottom end engaged with an anchor element 52. The anchor element 52 includes-a substantially semi-circular body 521 and a pin 522 located above the body 521. The body 521 has a slot 523 and two latch lugs 524 located at the bottom on two lateral sides thereof. The body 521 further has another side pressing against a slide key 53. The slide key 53 also presses against a slant side 131 of a push key 13 mounted to the top end of a control element 12 of the pulling bar 11.

The turning section 60 consists of a front latch sheath 61 and a rear latch sheath 62 for coupling the rod 42 of the support section 40. The front latch sheath 61 and the rear latch sheath 62 have respectively two sides each forms a curved latch rim 611, 621. The front latch sheath 61 has a retain pin 612 located therein. The rear latch sheath 62 has a slide groove 622 formed therein. The retain pin 612 runs through the slot 523 of the anchor element 52 of the control section 50.

The coupling section 70 consists of a left coupling elbow 71 and a right coupling elbow 72 to respectively engage with two sides of the turning section 60. The right coupling elbow 72 houses the slide key 53 of the control section 50 and allows the control element of one pulling bar 11 to pass through. The left coupling elbow 71 and the right coupling elbow 72 have respectively cross-shaped notches 711, 721 formed therein corresponding to one another, and have respectively an indented groove 712, 722 to couple with the latch rims 611, 621 of the turning section 60. The left coupling elbow 71 and the right coupling elbow 72 are fastened respectively to the pulling bars 11 through screws 713, 723 at a lower section thereof.

Figure 5:
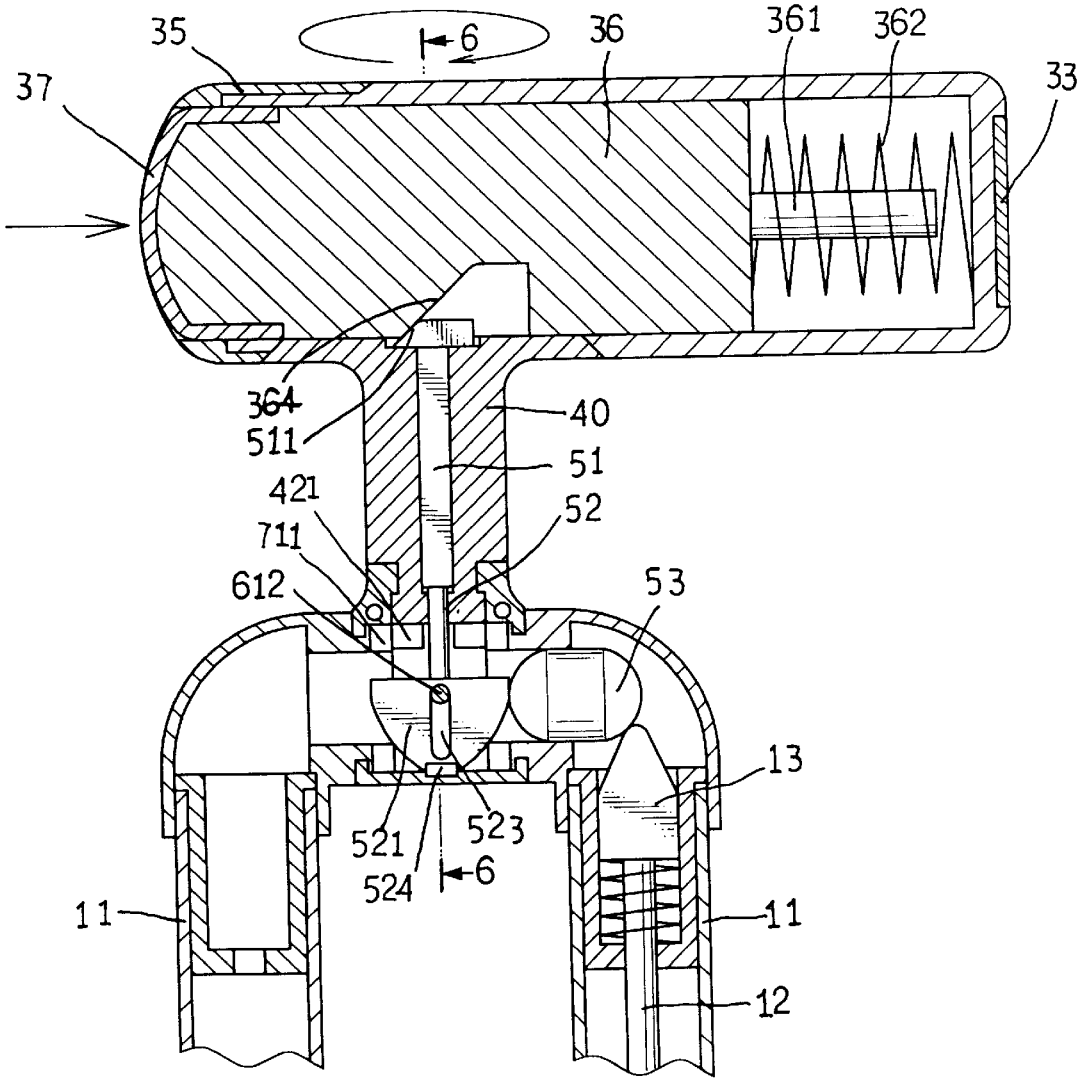
FIG.5 is a schematic view of the invention in use.

The invention may be operated as follows:

1. For adjusting the elevation of the pulling bars 11 of the luggage 10 (referring to FIG. 5), users may adopt a general operation procedure as follows:

depress the cap 37 of the handle section 30 to move the push element 36, the slant surface 364 of the push element 36 will push the push rod 51 of the control section 50 downwards, the push rod 51 in turn will depress the anchor element 52 sliding downwards, then the body 521 will be moved to squeeze and move the slide key 53 rightwards, as a result, the push key 13 of the control element 12 will be pushed, and the elevation of the pulling bar 11 will be changed and adjusted. (the depressing movement of the control element 12 is a technique known in the art, thus is omitted here).

2. For adjusting the angle of the handle 20:

depress the cap 37 of the handle section 30 to move the push element 36, the slant surface 364 of the push element 36 will push the push rod 51 sliding downwards, the push rod 51 in turn will depress the anchor element 52 downwards (same as the operation for adjusting the elevation of the pulling bar), then the body 521 will be moved and disengaged from the notches 711, 721 of the coupling section 70 and the latch slot 421 of the support section 40, then the handle section 30 may be turned to a selected angle to engage with the longitudinal or transverse notches of the coupling section (the notches and latch slots are formed in a cross shape) without sliding downwards to form a latched and anchored condition.

Figure 6:
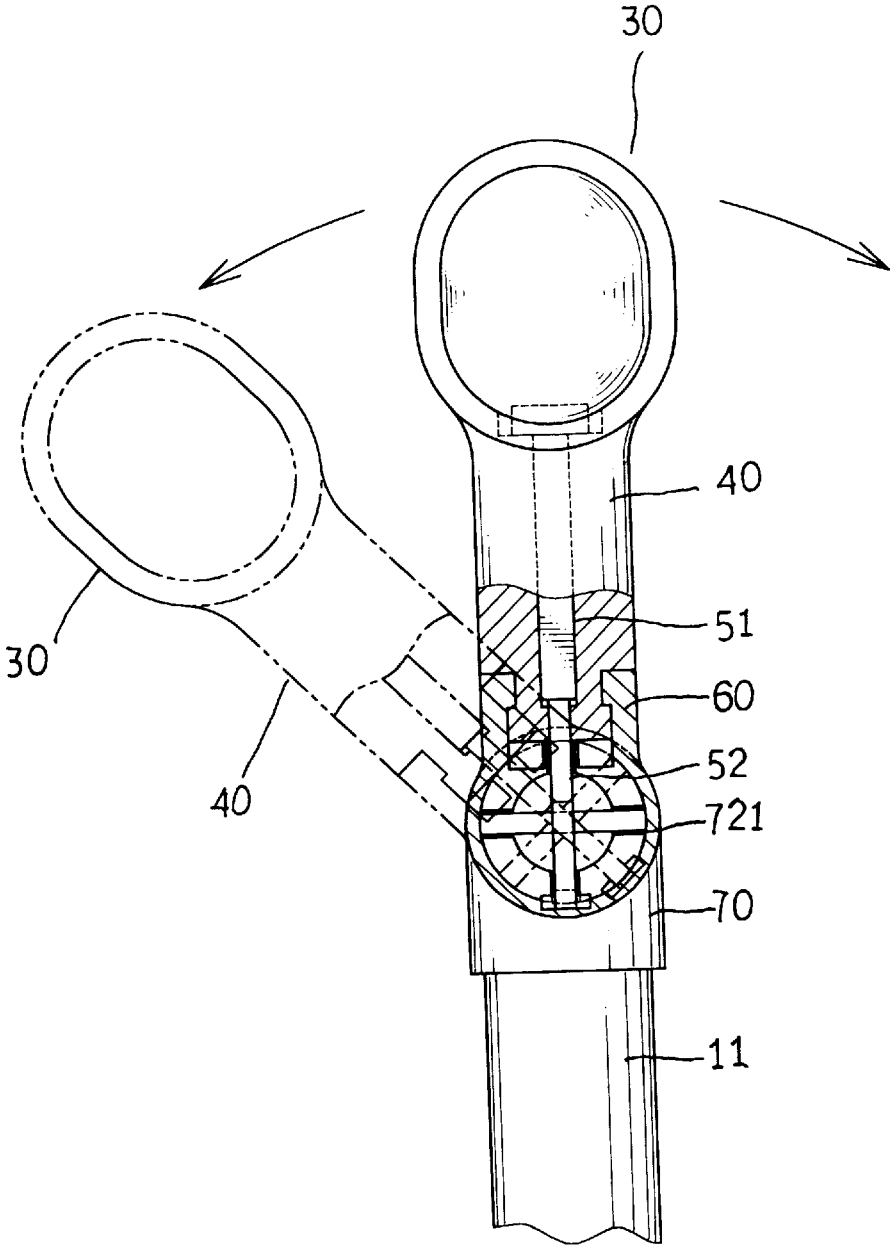
FIG.6 is a schematic view of the invention taken along line 6—6 in FIG. 5.

3. For adjusting the turning of the handle 20:

depress the cap 37 of the handle section 30 to move the push element 36, the slant surface 364 of the push element 36 will push the push rod 51 sliding downwards, the push rod 51 in turn will depress the anchor element 52 downwards (same as the operation for adjusting the elevation of the pulling bar), then the body 521 will be moved and disengaged from the notches 711, 721 of the coupling section 70 and the latch slot 421 of the support section 40, then the handle section 30 may be turned to move the turning section 60 with the latch rims 611, 621 of the latch sheathes 61, 62 sliding on the indented grooves 712, 722 of the left and right coupling elbows 71, 72. Thereby the handle may be turned and biased forwards or backwards (as shown in FIG. 6).

Furthermore, in order to make the invention capable of adjusting angle and direction in a multiple choices manner, the latch slot of the support section and the notches of the coupling section may be designed and formed in a radial fashion. Moreover, both sides of the body of the anchor element in the control section may be made to respectively contact a slide key and one control element is housed in the pulling bar so that the body may push the slide keys at two sides simultaneously for controlling the control elements located at two sides of the pulling bar.

By means of aforesaid constructions, the handle of luggage or trunks may be turned and adjusted to an angle desired, thus overcomes the disadvantages of the conventional luggage or trunks.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

I claim:

1. A handle structure for turning and adjusting direction, comprising:

a handle located on a top section of a luggage having a handle section which has a bottom rim; and a support section fastened to the bottom rim of the handle section having a control section located therein and a turning section located at a bottom end thereof, the turning section having two sides to couple respectively with a coupling section, the coupling section including a left coupling elbow and a right coupling elbow;

wherein the handle section includes a push element which has one end coupling with a spring and another end coupling with a cap, and a bottom engaging with a push rod of the control section, the push rod having a bottom end coupled with an anchor element, the anchor element having one side pressing a slide key which also presses a push key mounted to a top end of a control element, the turning section having two sides each having a latch rim engageable with an indented groove formed on the coupling section, the left coupling elbow and the right coupling elbow having respectively notches formed therein to latch the anchor element, the support section further having a bottom end which has a latch slot matching the left and the right coupling elbow to allow the anchor element forming an engaging or detaching condition;

wherein the cap is depressable to move the anchor element of the control section downwards for turning the handle or biasing the handle forwards or rearwards.

2. The handle structure for turning and adjusting direction of claim 1, wherein:

the handle section includes a casing which is formed by coupling two arched shells, the shells having respectively a side wall which has an indented recess to form a retain arch, the indented recess having a screw bore, the casing having one end fastened to a fastening blade through a screw and another end formed an opening and a coupling trough for housing a coupling sleeve, the coupling sleeve having an aperture at one end thereof for housing the push element and a screw bore located on an upper side thereof to engage with a screw for fastening the coupling sleeve to the casing, the push element having one end formed a jutting strut to couple with a spring and another end formed a jutting rim to couple with the cap, and a bottom which has a slant surface formed thereon;

the support section has a concave saddle seat to couple with the retain arch of the handle section, the saddle seat having two sides each having an aperture to engage with a screw for fastening the saddle seat through the screw bore of the retain arch to the handle section, the saddle seat further having a rod located thereunder, the rod having a bottom end forming a latch slot, the saddle seat also having a through cavity running therethrough to house the control section;

the control section includes a bias edge formed on a top end of the push rod to match the slant surface of the push element, the anchor element located beneath the push rod having a substantially semi-circular body and a pin located above the body, the body having a slot and two latch lugs located at the bottom on two lateral sides thereof, and having another side pressing the slide key;

the turning section includes a front latch sheath and a rear latch sheath for coupling the rod of the support section, the front latch sheath and the rear latch sheath having respectively two sides each as forming the latch rim which is curved, the front latch sheath having a retain pin located therein, the rear latch sheath having a slide groove formed therein, the retain pin running through the slot of the anchor element of the control section; and the coupling section consists of the left coupling elbow and the right coupling elbow to respectively engage with the two sides of the turning section, the right coupling elbow housing the slide key of the control section and allowing the control element located in a pulling bar to pass through such that the slide key pressing against the push key mounted to the top end of the control element, the left coupling elbow and the right coupling elbow having respectively the notches formed therein corresponding to one another, and have respectively the indented groove to couple with the latch rims of the turning section, the left coupling elbow and the right coupling elbow having respectively a lower section fastened to the pulling bar through a screw.

3. The handle structure of claim 1 or 2, wherein the push key of the control element has a slant side pressing the slide key of the control section.

4. The handle structure of claim 1 or 2, wherein the notches of the left coupling elbow and the right coupling elbow are selectively formed radially or in a cross shape.

5. The handle structure of claim 1 or 2, wherein the latch slot of the support section is selectively formed radially or in a cross shape.

6. The handle structure of claim 1 or 2, wherein one slide key is deployed at either of two sides of the body of the anchor element in the control section, the pulling bar having a control element located therein to allow the body to push the slide keys at two sides simultaneously for controlling the anchor element located at two sides of the pulling bar.

* * * * *